US006364470B1

(12) United States Patent
Cabal et al.

(10) Patent No.: US 6,364,470 B1
(45) Date of Patent: Apr. 2, 2002

(54) CONTINUOUS INK JET PRINTER WITH A NOTCH DEFLECTOR

(75) Inventors: Antonio Cabal, Fairport; Christopher N. Delametter, Rochester; Gilbert A. Hawkins, Mendon, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/475,639

(22) Filed: Dec. 30, 1999

(51) Int. Cl.[7] ..... B41J 2/07
(52) U.S. Cl. ..... 347/82
(58) Field of Search ..... 377/74–75, 77; 342/82, 20, 54, 44, 47; 347/82, 77, 74, 73, 54, 20

(56) References Cited

U.S. PATENT DOCUMENTS

| | | | | |
|---|---|---|---|---|
| 1,941,001 A | | 12/1933 | Hansell | 347/75 |
| 3,373,437 A | | 3/1968 | Sweet et al. | 347/75 |
| 3,416,153 A | | 12/1968 | Hertz et al. | 347/75 |
| 3,878,519 A | | 4/1975 | Eaton | 347/75 |
| 4,005,435 A | * | 1/1977 | Lundquist et al. | 347/75 |
| 4,274,100 A | * | 6/1981 | Pond | 347/77 X |
| 4,345,259 A | * | 8/1982 | Reitberger | 347/82 |
| 4,346,387 A | | 8/1982 | Hertz | 347/75 |
| 5,489,812 A | | 2/1996 | Furuhata et al. | 347/75 |
| 5,755,408 A | | 5/1998 | Schmidt et al. | 347/75 |
| 5,963,235 A | * | 10/1999 | Chwalek et al. | 347/82 |
| 5,966,154 A | * | 10/1999 | DeBoer | 347/82 |

FOREIGN PATENT DOCUMENTS

JP 4-294147 A * 10/1992 ..... B41J/2/07

* cited by examiner

*Primary Examiner*—David F. Yockey
(74) *Attorney, Agent, or Firm*—Walter S. Stevens

(57) ABSTRACT

There is provided by this invention a unique printing system that utilizes a notch deflector in the ink delivery channel of a continuous ink jet printing system to control the angle of deflection ink droplets in a print and non-print direction. The width and depth of the notch in the ink delivery channel can be varied to produce different angles of deflection of the ink droplets for a given velocity of ink through the channel. Also, for any predetermined width and depth of the notch in the ink delivery channel, the deflection angle of the droplets will vary with varying velocities of ink flow. Control circuits are connected to the notch deflector to adjust the depth of the deflector for different angles of deflection.

14 Claims, 7 Drawing Sheets

CONTINUOUS INK JET PRINTER WITH A NOTCH DEFLECTOR

FIELD OF THE INVENTION

This invention relates generally to the field of digitally controlled printing devices and methods, and in particular to continuous ink jet print heads and methods which integrate multiple nozzles on a single substrate and in which the breakup of a liquid ink stream into droplets is caused by a periodic disturbance of the liquid ink stream.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires very expensive setup and is seldom commercially viable unless a few thousand copies of a particular page are to be printed.

Inkjet printing has become recognized as a prominent contender in the digitally controlled, electronic printing arena because of its non-impact, low-noise characteristics, its use of plain paper and its avoidance of toner transfers and fixing. Ink jet printing mechanisms can be categorized as either continuous ink jet or drop on demand ink jet. Continuous ink jet printing dates back to at least 1929. See U.S. Pat. No. 1,941,001 issued to Hansell.

U.S. Pat. No. 3,373,437, which issued to Sweet et al. in 1967, discloses an array of continuous ink jet nozzles wherein ink drops to be printed are selectively charged and deflected towards the recording medium. This technique is known as binary deflection continuous ink jet.

U.S. Pat. No. 3,416,153, which issued to Hertz et al. in 1966, discloses a method of achieving variable optical density of printed spots in continuous ink jet printing using the electrostatic dispersion of a charged drop stream to modulate the number of droplets which pass through a small aperture.

U.S. Pat. No. 3,878,519, which issued to Eaton in 1974, discloses a method and apparatus for synchronizing droplet formation in a liquid stream using electrostatic deflection by a charging tunnel and deflection plates.

U.S. Pat. No. 4,346,387, which issued to Hertz in 1982, discloses a method and apparatus for controlling the electric charge on droplets formed by the breaking up of a pressurized liquid stream at a drop formation point located within an electric field having an electric potential gradient. Drop formation is effected at a point in the field corresponding to the desired predetermined charge to be placed on the droplets at the point of their formation.

Conventional continuous ink jet utilizes electrostatic charging rings that are placed close to the point where the drops are formed in a stream. In this manner individual drops may be charged. In addition to charging rings, deflection plates having a large potential difference between them may be used to deflect drops which are charged downstream. Uncharged drops are not deflected.

In all such continuous ink jet printers, a gutter (sometimes referred to as a "catcher") intercepts ink drops not intended for printing. For example, charged drops may be deflected so as to miss the gutter and thereby pass on as print drops to a receiver, whereas uncharged drops are captured by the gutter.

U.S. Pat. No. 6,079,821, issued Jun. 27, 2000, discloses a continuous ink jet printer system in which heat is applied asymmetrically to an ink stream to control the direction of the stream between a print direction and a non-print direction. This method renders unnecessary the electrostatic charging tunnels of conventional continuous ink jet technologies and serves to better couple the functions of droplet formation and droplet deflection. However, the ink stream must be heated for deflection to occur.

The continuous ink jet printer described in accordance with the present invention eliminates the need for electrostatic charging systems and deflection plates in continuous ink jet printers without requiring the addition of heat to control the direction of the ink stream between a print direction and a non-print direction.

It is an object of the present invention to provide a high speed apparatus and method of page width printing utilizing a continuous ink jet method whereby drop formation and deflection may occur at high repetition.

It is another object of the present invention to provide an apparatus and method of continuous ink jet printing with a drop deflection mechanism which can be integrated with the print head utilizing the advantages of silicon processing technology offering low cost, high volume methods of manufacture.

It is another object of the present invention to provide an apparatus and method of high speed printing that can use a wide variety of inks.

It is yet another object of the present invention to provide an apparatus and method for continuous ink jet printing that does not require electrostatic charging plates.

It is still another object of this invention to provide a continuous ink jet printing system that integrates an ink stream deflection means into the nozzle of a continuous ink jet printer.

The invention, and its objects and advantages, will become more apparent in the detailed description of the preferred embodiments presented below.

SUMMARY OF THE INVENTION

There is provided by this invention a print head of the continuous ink jet type wherein multiple nozzles are fabricated into a silicon substrate. Annular heaters may be fabricated around the nozzles to create variable size drop formation in the ink stream. A notch in the nozzle bore having a predetermined width and adjustable depth accomplishes deflection of the drops for printing.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
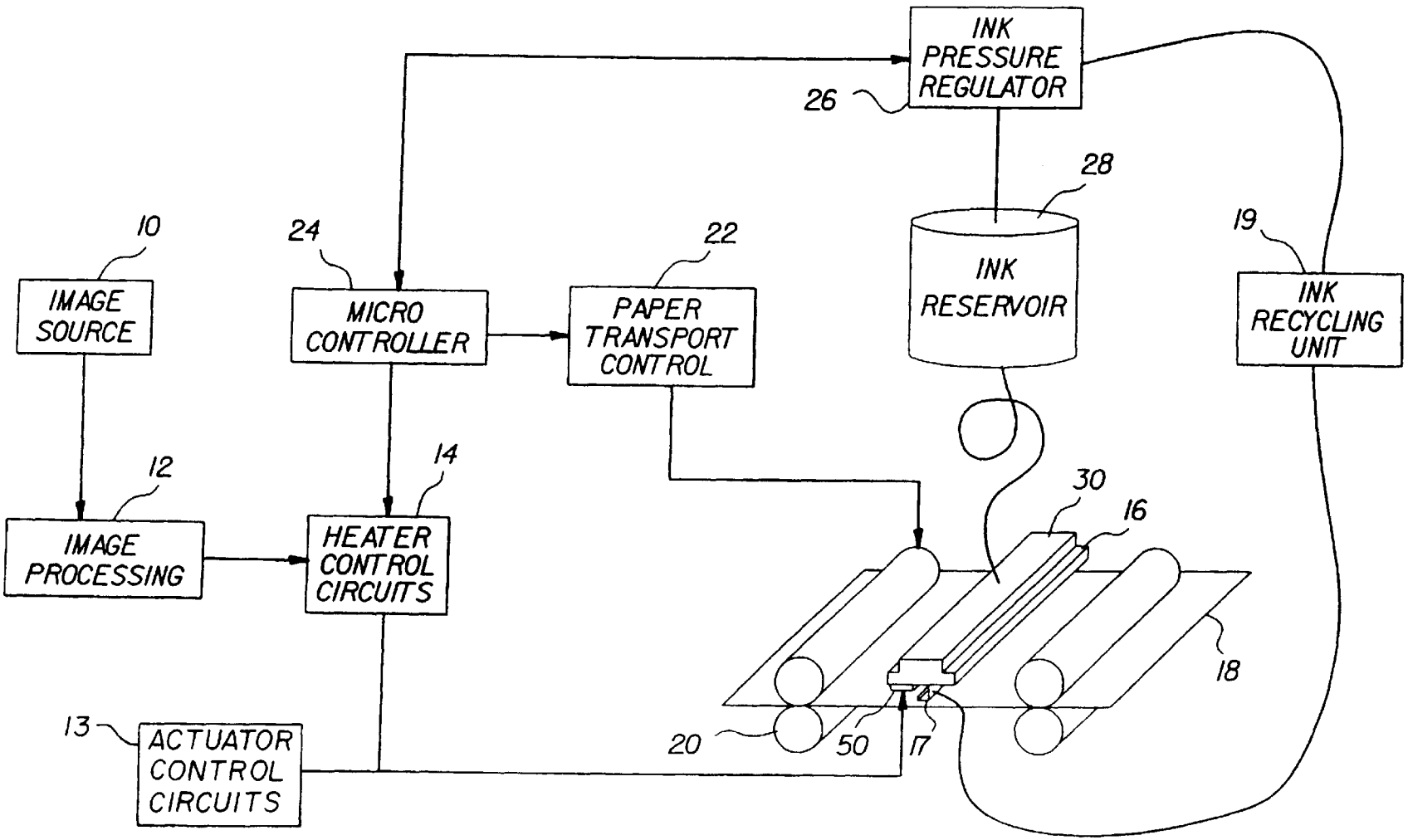
FIG. 1 shows a simplified block schematic diagram of one exemplary printing apparatus according to the present invention.

Referring to FIG. 1, there is shown a continuous ink jet printer system that includes an image source 10 such as a scanner or computer which provides raster image data, outline image data in the form of a page description language, or other forms of digital image data. This image data is converted to multi-level half-toned bitmap image data by an image-processing unit 12 that also stores the image data in memory. A plurality of heater control circuits 14 read data from the image memory and applies time-varying electrical pulses to a set of nozzle heaters 50 that are part of a print head 16. These pulses are applied at an appropriate time, and to the appropriate nozzle, so that drops formed from a continuous ink jet stream will form spots on a recording medium 18 in the appropriate position designated by the data in the image memory. Micro-actuator control circuits 13 apply a signal to the nozzle to control the deflection of the drops to the recording medium 18 in a manner hereinafter described.

Recording medium 18 is moved relative to print head 16 by a recording medium transport system 20, which is electronically controlled by a recording medium transport control system 22, and which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width print heads, it is most convenient to move recording medium 18 past a stationary print head. However, in the case of scanning print systems, it is usually most convenient to move the print head along one axis (the sub-scanning direction) and the recording medium along an orthogonal axis (the main scanning direction) in a relative raster motion.

Ink is contained in an ink reservoir 28 under pressure. In the non-printing state, continuous ink jet drop streams are unable to reach recording medium 18 due to an ink gutter 17 that blocks the stream and which may allow a portion of the ink to be recycled by an ink recycling unit 19. The ink-recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of print head 16 by an ink channel device 30. The ink preferably flows through slots and/or holes etched through a silicon substrate of print head 16 to its front surface, where a plurality of nozzles, micro-actuators, and heaters are situated. With print head 16 fabricated from silicon, it is possible to integrate heater control circuits 14 and micro-actuator control circuits 13 with the print head.

Figure 2:
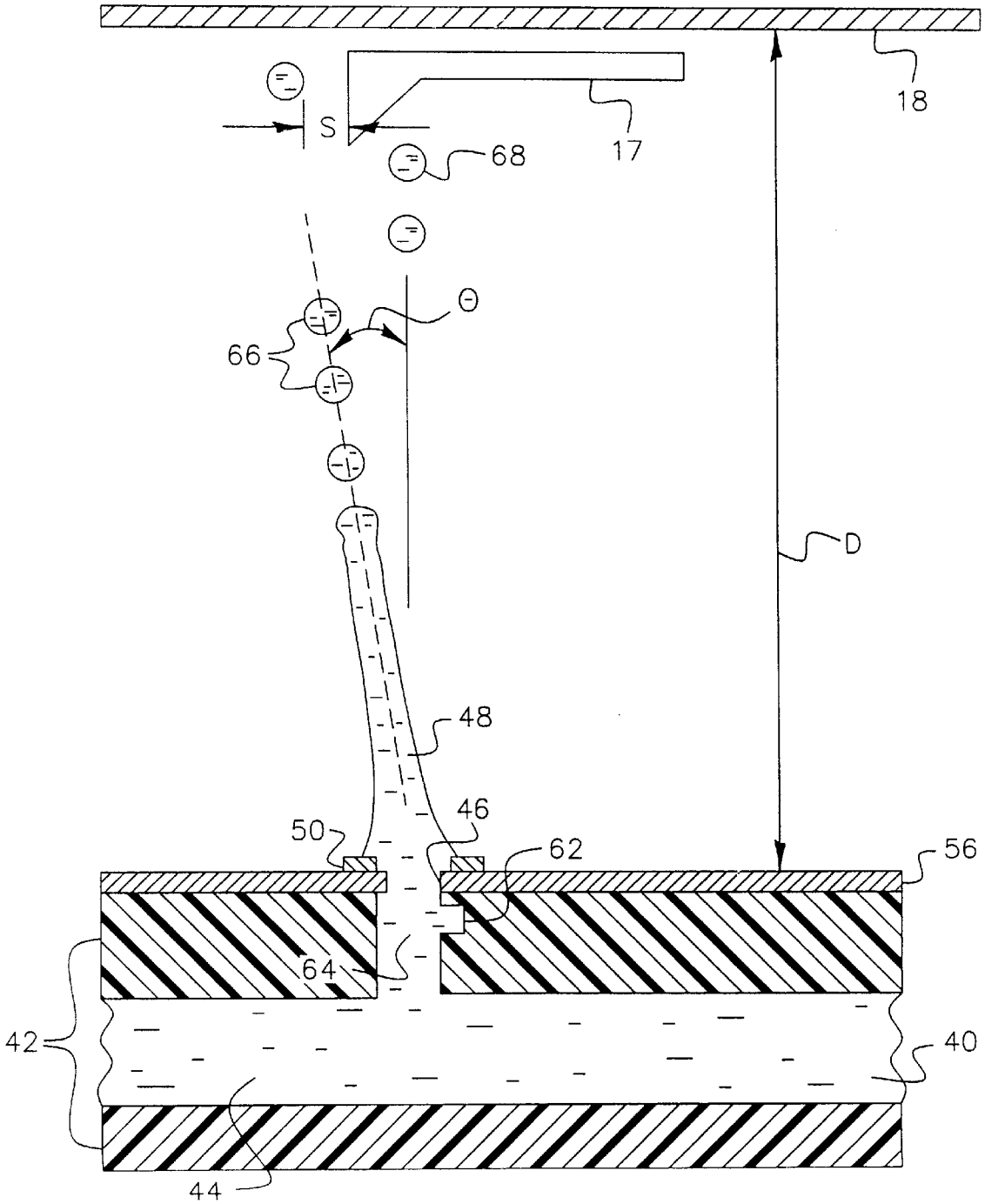
FIG. 2 shows schematically a view of the nozzle bore in cross-section with a notch deflector for deflection of the ink drops for printing.
Figure 3:
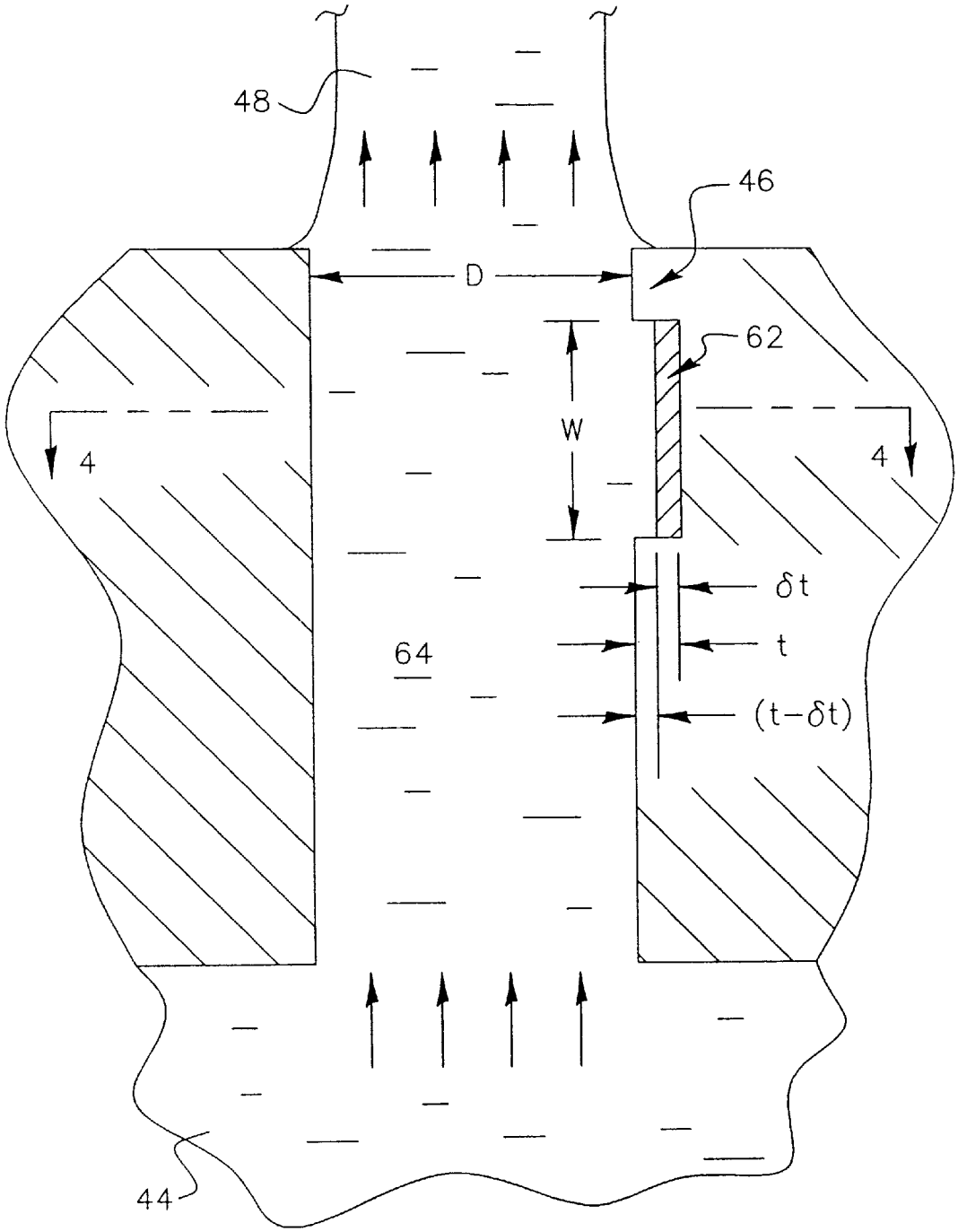
FIG. 3 shows a sectional view of the nozzle bore with the notch incorporating the principles of this invention.

Referring to FIG. 2 there is shown a cross-sectional view of one nozzle tip of an array of such tips in a silicon substrate that forms a continuous ink jet print head 16 of FIG. 1 according to a preferred embodiment of the present invention. Ink is delivered to lateral ink delivery channels 40 in substrate 42 and flows through vertical ink delivery channels 64 and out of the substrate through nozzle bores 46. Thereby, lateral ink delivery channels 40, along with a plurality of vertical ink delivery channels 64 and nozzle bores 46 are provided in the substrate 42. In the preferred embodiment, the substrate is made of silicon and the delivery channels and nozzle bores are formed by reactive plasma etching, as is well known in the art of micro-machining. In other preferred embodiments, the substrate is plastic (i.e. a polymer) and injection molding is used to form the delivery channels and nozzle bores. In yet another preferred embodiment, the substrate is glass and the delivery channels and nozzle bores are formed by wet etching and abrasive cutting. The nozzle bores 46, which define the ink exit apertures at the top surface of substrate 42 of vertical ink delivery channels 64, are preferably circular in cross-section when viewed from the top; but shapes other than circular may be advantageously used as well. In the preferred embodiment of the present invention, as shown in FIG. 2 and FIG. 3, the vertical ink delivery channels 64 are substantially cylindrical channels that allow ink to be delivered from the lateral ink delivery channels 40 to the top surface of substrate 42. As shown in FIGS. 2 and 3, notch deflectors 62, to be described, lie in the walls of the upper portions of vertical ink delivery channels 64. The nozzle bores 46 are at the top of the vertical ink delivery channels 64 and hence at the top surface of substrate 42. The nozzle bores 46 lie above the notch deflectors 62 to be described.

Ink 44 in lateral ink delivery channel 40 is pressurized above atmospheric pressure, and thereby forms an ink stream 48 which is ejected from the nozzle bore, as is well known in the art of continuous ink jet printing. At a distance above nozzle bore 46, stream 48 breaks into a plurality of drops 66, preferably due to heat pulses supplied by a heater 50. The droplets so produced are regularly spaced and of equal size, so that the heater may be said to perform the function of a drop regulator 52. The heater 50 may be in the form of a ring which surrounds stream 48 and provides heat to stream 48 from all sides or may alternatively be in the form of a split heater which provides heat asymmetrically to stream 48. The heat required to break stream 48 into a plurality of drops 66 is very small, so that no thermal damage to the ink occurs, thermal damage being a problem known in the art of thermal ink jet printing. Heater 50 provides heat pulses to stream 48 under the control of heater control circuits 14 shown in FIG. 1. Heater 50 is preferably separated from substrate 42 by thermal and electrical insulating layers 56 to minimize heat loss to the substrate. In this case, the nozzle bore may be made in insulating layers 56.

Figure 6:
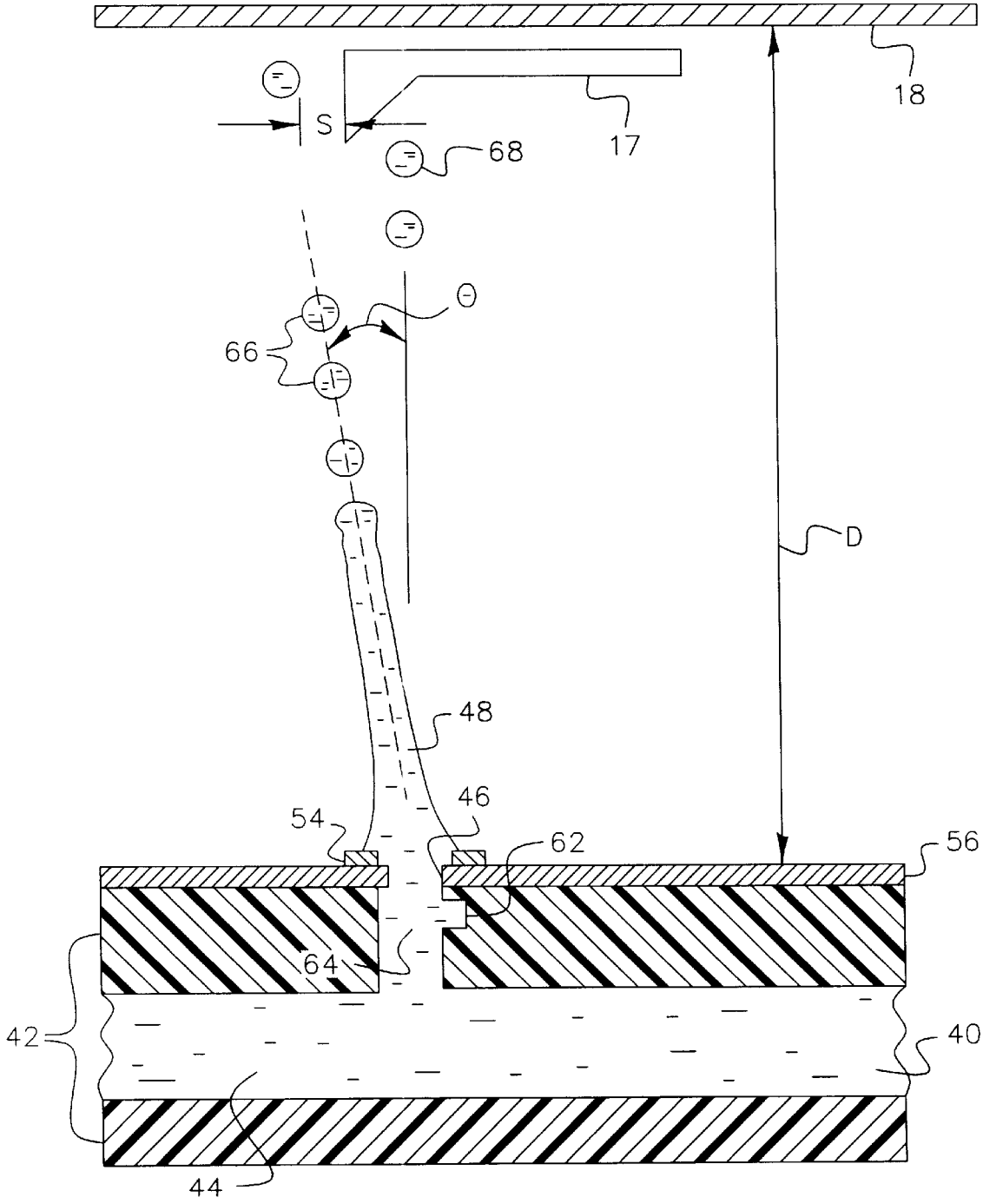
FIG. 6 shows schematically a view of the nozzle bore in cross-section with a notch deflector for deflection of the ink drops for printing.

In the preferred embodiment, the ink stream 48 is heated by heat pulses from heater 50 and breaks into droplets 66 shown in FIG. 2. The droplets so produced are regularly spaced and of equal size. However, other means of drop regulation are possible. For example, high frequency sound waves, may also be employed, alone or in conjunction with heat pulses, to break ink stream 48 into drops, as is well known in the art of continuous ink jet printing. Referring to FIG. 6, such sound waves may be provided by an ultrasonic transducer 54 disposed near or in place of heater 50. Alternatively, the ink stream may be allowed to break up into drops at random by excluding or minimizing externally produced perturbations, such as external heat pulses or sound waves, as is well known in the art of fluid instabilities in small streams. However, in this latter case, the size of the drops will not generally be identical one to another nor will they be spaced regularly. In this case, no drop regulator 52 is used.

As shown in FIG. 2 and in detail in FIG. 3, a notch deflector 62, which for purposes of illustration may be thought of as a moveable piston located in the wall of ink delivery channel 64, has a predetermined width "W" along the direction of vertical ink delivery channel 64 (shown vertically disposed) and an adjustable depth shown as (t-δt) in FIG. 3 which measures the distance by which the left edge (dotted line in FIG. 3) of the notch deflector 62 is displaced from the right (dotted line in FIG. 3) edge of the vertical ink delivery channel 64 in a direction substantially perpendicular to direction of vertical ink delivery channel 64. Preferably, depth (t-δt) is positive, as shown in FIG. 3, so that a depression is formed in the wall of the vertical ink delivery channel. The maximum distance of the left edge (FIG. 3) of the notch deflector 62 is displaced from the right (FIG. 3) edge of the vertical ink delivery channel 64 in a direction substantially perpendicular to direction of vertical ink delivery channel 64 is "t" in FIG. 3. In accordance with the present invention, the depth (t-δt) can be varied. Preferably, depth (t-δt) is positive, as shown in FIG. 3, so that generally a depression is formed in the wall of the vertical ink delivery channel. As the depth (t-δt) is varied by moving the notch deflector to the right in FIG. 3, the depth of the "depression" in the vertical ink delivery channel just below the nozzle bore increases. Thus, the notch deflector generally includes a depression in the wall of the vertical ink delivery channel and a means of controlling the depth of the depression.

The notch deflector 62, when the distance (t-δt) is not zero, surprisingly promotes ink drop deflection for printing. It is the presence of notch deflector 62 in FIG. 2 that accounts for the direction of motion of ink drops 66 lying away from the vertical axis by an angle labeled "θ" in FIG. 2. If the distance (t-δt) in FIG. 3 is not zero, then the ink flowing along the right edge (FIG. 3) of vertical ink delivery channel 64 flows along a surface which is not planar, and, as will be shown, such flow causes a deflection of the stream 48 and drops 66 from the vertical direction. If the distance (t-δt) in FIG. 3 is made zero, then ink flowing along the right edge (FIG. 3) of vertical ink delivery channel 64 flows along a surface which is planar in FIG. 3 and which therefore resembles a surface of an ink delivery channel having no notch deflector. In this case, no deflection occurs. The notch deflector 62 is connected to the micro-actuator circuits 13 to control the depth (t-δt) of the edge of the notch deflector 62 from the edge of the vertical ink delivery channel 64 as shown in FIG. 1. In this regard notch deflector 62 may be formed of a piezoelectric material that moves when electrically stimulated by circuits 13. Alternatively, notch deflector 62 may be connected to a suitable mechanical or hydraulic mechanism (not shown) capable of moving deflector 62. While it is possible in accordance with the present invention for the micro-actuator circuits 13 to cause the notch deflector to extend into the ink delivery channel 64, this is not the preferred method of operation. Thus, the notch deflector generally includes a depression in the wall of the vertical ink delivery channel.

The angle θ (FIG. 2) of deflection of the ink drop stream is dependent upon the width (W) and depth (t-δt) of the notch and the velocity of the ink passing through the vertical ink delivery channel 64, as will be shown. In accordance with the present invention, ink droplets 66 are deflected away from the gutter 17 for printing on the recording medium 18 (FIG. 2) and non-deflected droplets 68 fall into the gutter 17 for non-printing in a manner determined by the depth (t-δt). In an alternate printing scheme, ink gutter 17 may be placed to block deflected drops 66 so that only non-deflected drops 68 will be allowed to reach recording medium 18.

In printing, an important system parameter is the angle θ which characterizes the angle at which the ink stream deflects. The angle θ is shown in FIG. 2 as the angle formed between a line connecting the deflected ink drops 66 to the center of the nozzle bore on the surface of electrical insulating layers 56 and a line normal to the electrical insulating layers 56 centered at the nozzle bore 46. Greater drop deflection results in a more robust system. The larger the deflection angle θ the closer the ink gutter 17 may be placed to the print head 16 (FIG. 1) and hence print head 16 can be placed closer to recording medium 18. The distance D from the top surface of the substrate 42 to the gutter 17 is shown in FIG. 2. In general, shorter drop travel distances D will result in lower drop placement errors, which will result in higher image quality. Also, for a particular distance D, larger deflection angles θ result in larger deflected drop 66 to ink gutter 17 spacing (this distance is shown as S in FIG. 2) which would allow a larger ink gutter 17 to print head 16 alignment tolerance.

Figure 5:
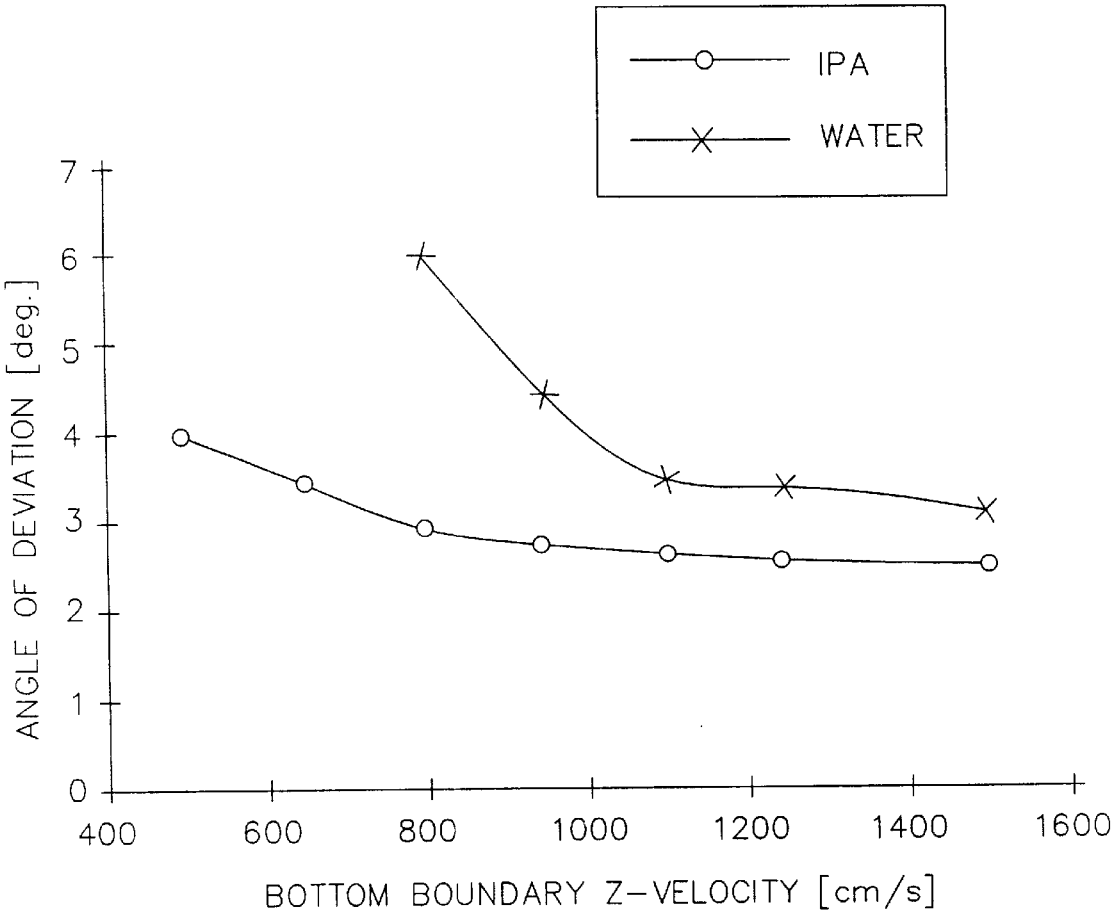
FIG. 5 shows the angle of deflection variations of water based inks and isopropyl alcohol (IPA) based inks versus a range of inflow velocities for a given notch deflector depth.

FIG. 3 illustrates a detailed sectional view of nozzle bore 46 and the notch-actuator 62 in the vertical ink delivery channel 64. It will be appreciated that the apparatus may vary as to configuration and as to details of the parts without departing from the basic concept as disclosed herein. In particular, the heater 50 at the top surface of substrate 42 shown in FIG. 2 where ink stream 48 exits the nozzle bore 46 is not shown. As noted previously, its function of breaking ink stream 48 into drops 66 can be achieved by other means or heater 50 may be omitted entirely. Referring to FIG. 3, the notch deflector 62, which for purposes of illustration may be thought of as a moveable piston located in the wall of ink delivery channel 64, has an initial position such that its left edge (dotted line in FIG. 3) is in line with the edge of ink delivery channel 64 (equivalent to the conditions depth=0 or δt=t) so that ink would flow in ink delivery channel 64 in the region of the notch deflector just as if no notch actor were present. In the initial position, the ink stream direction is not deflected, i.e. the angle θ of FIG. 2 is zero. When the notch deflector is moved from the initial position so that it is displaced to the right (FIG. 3) by an amount (t-δt), the ink stream direction is deflected, i.e. the angle θ is no longer zero. This is the condition shown in FIG. 3. We have found that a surprising small notch depth, in particular a depth which is not difficult to accomplish experimentally, is sufficient to generate a relatively large deflection angle, in particular an angle sufficient to provide the deflection required by the ink jet printing system describe in FIG. 1. For example it has been found that for a geometry such that the diameter of nozzle bore 46 of 8.8 microns, a notch deflector width W=8.8 microns, and a notch deflector depth t-δt=0.88 microns, an angle of deflection of 5 degrees is achieved in the case of water based inks with an ink stream velocity of 9 m/s. This data is shown in FIG. 5 which plots the angle of deflects for two inks, one IPA based and one water based, as a function of the velocity of the ink stream in the nozzle bore. As is well known in the art of continuous ink jet printing, an angle of deflection of 5 degrees is adequate for robust print systems.

Although a cross-sectional view, such as that shown in FIG. 3, represents the device in two dimensions and serves to illustrate the essential features of the present invention, the actual device and models of the device depend on its three dimensional geometry. As noted previously, the examples cited here correspond to a three dimensional geometry in which the vertical ink delivery channel 64 is substantially cylindrical in shape, and the notch deflector occupies about one-half of the inner periphery of the vertical ink delivery channel 64 when the device is viewed from above. The notch deflector can occupy more of less than one-half of the inner periphery of the vertical ink delivery channel 64 when the device is viewed from above in other preferred embodiments. Also, other preferred embodiments of the present invention include positioning more than one notch deflector 62 around the periphery of the vertical ink delivery channel 64, the notch deflectors occupying an appreciable amount of the inner periphery of the vertical ink delivery channel 64 when the device is viewed from above, for example a fraction between 0.015 and 1.0 of the total inner periphery.

Figure 7:
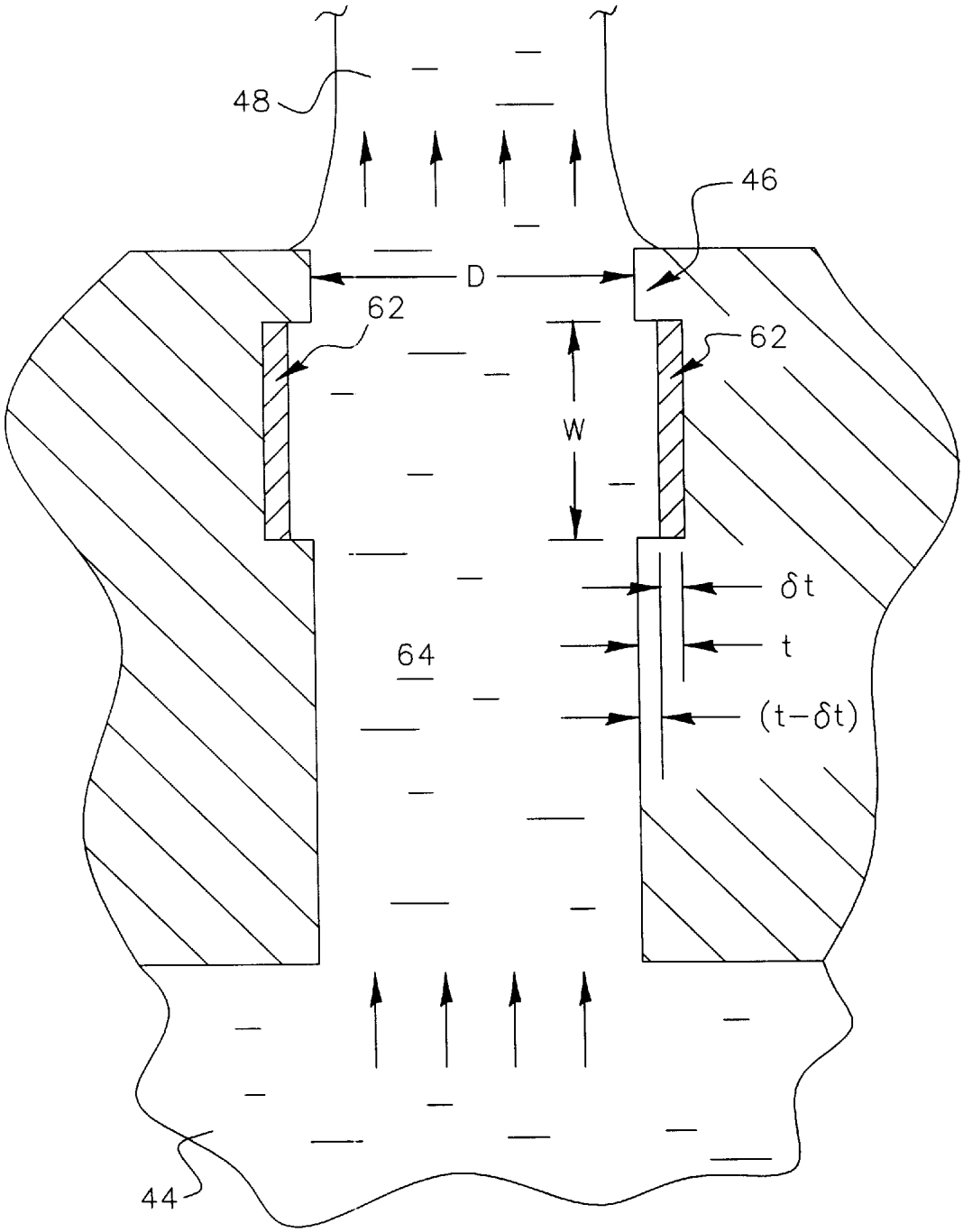
FIG. 7 shows a sectional view of the nozzle bore with two notch deflectors.

In the case of more than one notch deflector, each notch deflector exerts an influence on the deflection of the ink stream in the direction of a line between the notch deflector and the center of the bore. Referring to FIG. 7, in a preferred embodiment of the present invention, there are two notch deflectors disposed across from one another, each similar to the notch deflector 62 shown in the cross-section of FIG. 3. In FIG. 7, the notch deflectors appear fully symmetric about a vertical line through the middle of the nozzle bore, with a notch deflector on both left and right sides. In this case, the ink stream could be deflected from to the left or to the right, depending on whether the right or left notch deflector were moved right or left, respectively, the deflection still lying in the plane of the paper in FIG. 2.

Figure 4:
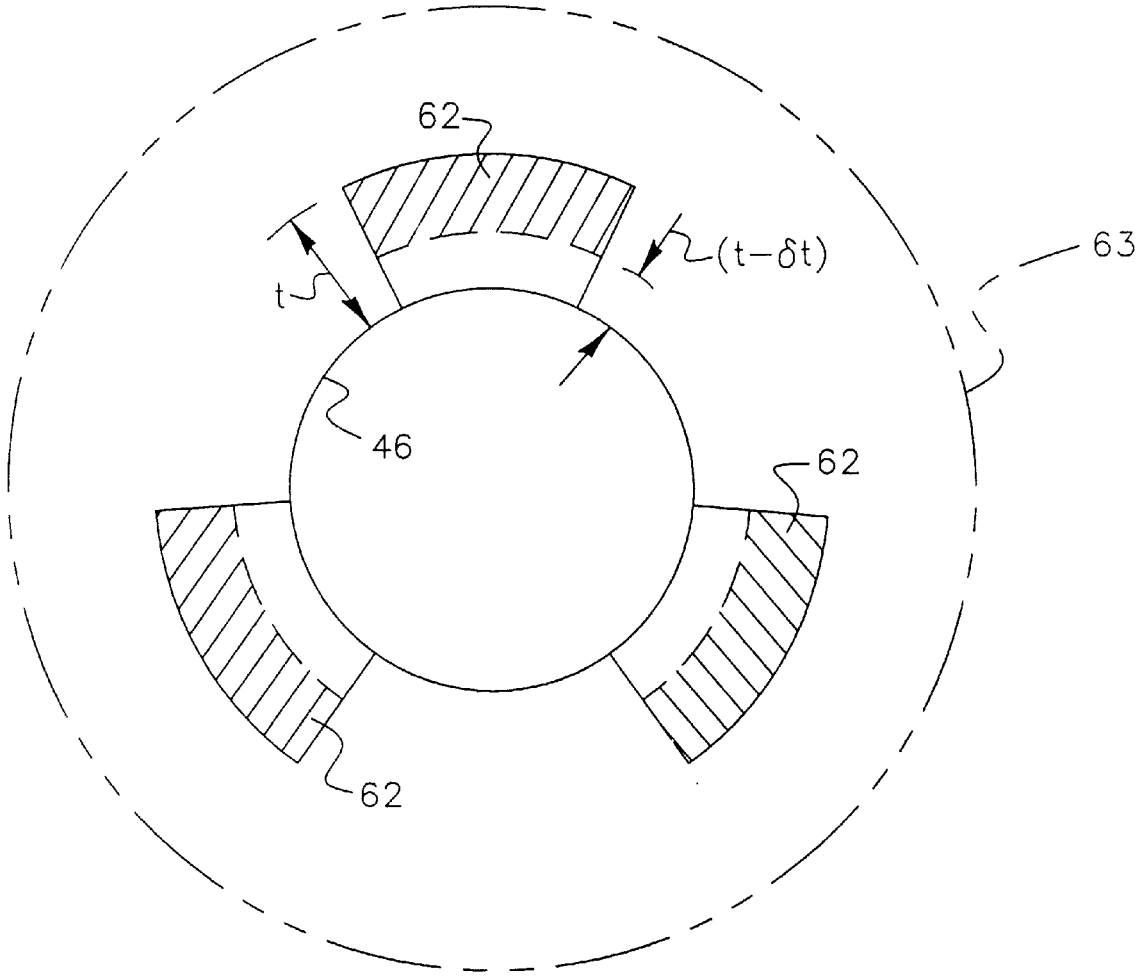
FIG. 4 is a view taken along section line 4—4 of FIG. 3, this view showing a nozzle bore having three notch deflectors spaced equally around the periphery of the nozzle bore incorporating the principles of this invention.

In another preferred embodiment, as shown in FIG. 4, three notch deflectors 62 are positioned approximately symmetrically about nozzle bore 46. When viewed from above, each notch deflector 62 preferably occupies about 0.25 of the inner periphery of the nozzle bore 46. As in the discussion related to FIG. 3, the dotted line in FIG. 4 indicates the edge of the notch deflector nearest the nozzle bore, and the distance between this edge and the inner wall of the vertical ink delivery channel forms a depression in the wall of the ink delivery channel.

As in the case of a single notch deflector, the position of the additional notch deflectors shown in FIG. 4 is controlled by additional micro actuator control circuits B (not shown). Also, as shown in FIG. 4, the positions of all three notch deflectors are similar in that the depths of the depression they form in the wall of the vertical ink delivery channel underneath nozzle bore 46 are about equal. Thus the ink drops ejected from the nozzle bore 46 come straight out of the plane of the paper in FIG. 4 because of the symmetric actions of three notch deflectors on the ink stream. However, by altering the positions of one or more of the notch deflectors, ink stream 48 may be directed in an arbitrary direction with respect to the axis of the vertical ink delivery channel underneath the nozzle bore 46. This axis is perpendicular to the plane of FIG. 4 and centered on the nozzle bore 46. The ability to steer the ink stream in an arbitrary direction is illustrated schematically by region 63 in FIG. 4 which depicts an imaginary plane located above (out of the plane of) nozzle bore 46, preferably a circular region located about 5 mm above the nozzle bore. Then, for example, by adjusting one or more of the notch deflectors, the ink drops from the ink stream ejected from nozzle bore 46 can be caused to pass anywhere within the region 63. For example, if the edge of the notch deflector (dotted line) in the lower left of FIG. 4 is controlled to move closer to the nozzle bore 46, ink drops will pass through the lower left of region 63. The small displacements that we have discovered are required of notch deflectors to achieve substantial deflection of ink stream 48 enables manufacture of devices having three or more notch deflectors. In particular, the use of 4 notch deflectors is also advantageous when each are equally spaced about a nozzle bore viewed from above because the motion of the ink stream can be controlled in orthogonal directions.

FIG. 5 illustrates the angle of deflection for the geometrical and fluid parameters of FIG. 3 but for various flow velocities of ink through the nozzle bore 46 and for two different fluids. The angle of deflection for water and isopropyl alcohol (IPA) based inks is shown. It can be seen that the angle of deflection is similar for the two fluids at higher velocities (it levels off) and increases with decreasing channel inflow velocities. As is well known in the art of ink jet printheads, it is advantageous from a system point of view to have a printhead which ejects drops similarly for fluids of widely differing compositions.

Although the descriptions above contains much specificity, these should not be constructed as limiting the scope of the invention but merely providing illustration of some of the presently preferred embodiments of this invention. Thus, it should be understood that variations and modifications could be effected within the spirit and scope of the invention.

PARTS LIST

10 scanner
12 image processing unit
13 micro actuator control circuits
14 heater control circuits
16 print head
17 ink gutter
18 recording medium
19 ink recycling unit
20 medium transport system
22 medium transport control system
24 micro-controller
26 ink pressure regular
28 ink reservoir
40 lateral vertical ink delivery channel
42 silicon substrate
44 ink
46 nozzle bore
48 ink stream
50 resistive heater
52 drop regulator
54 ultrasonic transducer
56 electrical insulating layers
62 notch deflector
63 region
64 vertical ink delivery channel
66 ink drops
68 non-deflected drops

What is claimed is:

1. An apparatus for controlling fluid in which a continuous stream of the fluid is emitted from a nozzle, said apparatus comprising:

a) a substrate having formed therein a fluid delivery channel having an interior wall;

b) a nozzle bore in the substrate forming an opening into the fluid delivery channel; and c) a notch deflector positioned inside the fluid delivery channel in proximity to the nozzle bore, wherein the notch deflector comprises a depression in the interior wall of the fluid delivery channel having a predetermined width and adjustable depth such that a direction of the continuous stream of the fluid is controlled.

2. The apparatus as set forth in claim 1, the notch deflector including an edge moveably positioned in the depression in the interior wall of the fluid delivery channel, wherein the position of the edge is varied to control an angle of deflection of the continuous stream of the fluid.

3. The apparatus as set forth in claim 1, wherein the notch deflector is a first notch deflector, the apparatus further comprising a second notch deflector positioned in the fluid delivery channel opposite the first notch deflector such that the continuous stream of the fluid is controlled in a plurality of directions.

4. The apparatus as set forth in claim 1, wherein the notch deflector is a first notch deflector, the apparatus further comprising at least two additional notch deflectors positioned around a periphery of the fluid delivery channel such that the continuous stream of the fluid is controlled in a plurality of directions.

5. A method for controlling ink in a continuous ink jet printer in which a continuous stream of ink is emitted from a nozzle, the method comprising:

providing a source of pressurized ink;

placing the source of pressurized ink in communication with an ink delivery channel having a wall;

forming a nozzle bore that opens into the ink delivery channel to establish a continuous flow of ink in a stream, the nozzle bore defining a nozzle bore perimeter;

providing a droplet regulator that causes the stream to break up into a plurality of droplets at a position spaced from the nozzle bore; and providing a notch in the ink delivery channel wherein the notch includes a depression in the wall of the ink delivery channel to control a direction of the droplets between a print direction and a non-print direction, and the notch includes an edge moveably positioned relative to the fluid delivery channel such that the depression has a variable depth.

6. The method for controlling ink in a continuous ink jet printer as recited in claim 5, wherein said droplet regulator comprises a resistive heater positioned around the nozzle bore perimeter.

7. A method for controlling ink in a continuous ink jet printer in which a continuous stream of ink is emitted from a nozzle; said process comprising:

providing a source of pressurized ink;

placing the source of pressurized ink in communication with an ink delivery channel having a wall;

forming a nozzle bore that opens into the ink delivery channel to establish a continuous flow of ink in a stream, the nozzle bore defining a nozzle bore perimeter;

providing a droplet regulator that causes the stream to break up into a plurality of droplets at a position spaced from the nozzle bore; and providing a notch deflector in the ink delivery channel, the notch deflector including a depression in the wall of the ink delivery channel, wherein a predetermined width and adjustable depth of the depression in the wall of the ink delivery channel control a direction of the droplets between a print direction and a non-print direction.

8. An apparatus for controlling fluid in which a continuous stream of the fluid is emitted from a nozzle, said apparatus comprising:

a) a substrate having formed therein a fluid delivery channel;

b) a nozzle bore in the substrate forming an opening into the fluid delivery channel; and c) a notch positioned inside the fluid delivery channel in proximity to the nozzle bore, wherein a direction of the continuous stream of the fluid is controlled, the notch including a depression formed in the fluid delivery channel and an edge moveably positioned relative to the fluid delivery channel such that the depression has a variable depth.

9. The apparatus as set forth in claim 8 in which the substrate is silicon.

10. The apparatus as set forth in claim 8 in which the substrate is a molded plastic.

11. The apparatus as set forth in claim 8, further comprising a component for breaking up the continuous stream of ink emitted from the nozzle into discreet ink droplets at a position spaced from the nozzle bore.

12. The apparatus as set forth in claim 11, wherein the component for breaking up the continuous stream of ink emitted from the nozzle includes a resistive heater positioned in proximity to the nozzle bore.

13. The apparatus as set forth in claim 11, wherein the component for breaking up the continuous stream of ink emitted from the nozzle includes an ultrasonic transducer.

14. The apparatus as set forth in claim 8, further comprising:

a source of fluid communicating with the fluid delivery channel wherein the fluid is pressurized above atmospheric pressure producing a continuous flow of the fluid in a stream from the nozzle bore.

* * * * *